US007874969B2

(12) United States Patent
Weir et al.

(10) Patent No.: US 7,874,969 B2
(45) Date of Patent: Jan. 25, 2011

(54) ABDOMINAL MUSCLE TRAINING DEVICE

(75) Inventors: Ross John Weir, Loughborough (GB); Michael Peter Caine, Cropston (GB)

(73) Assignee: Progressive Sports Technologies, Limited (GB)

( * ) Notice: Subject to any disclaimer, the term of this patent is extended or adjusted under 35 U.S.C. 154(b) by 169 days.

(21) Appl. No.: 11/991,117

(22) PCT Filed: Aug. 30, 2006

(86) PCT No.: PCT/GB2006/050264

§ 371 (c)(1),
(2), (4) Date: Feb. 27, 2008

(87) PCT Pub. No.: WO2007/026179

PCT Pub. Date: Mar. 8, 2007

(65) Prior Publication Data

US 2009/0280968 A1 Nov. 12, 2009

(30) Foreign Application Priority Data

Aug. 31, 2005 (GB) ..... 0517689.6

(51) Int. Cl.
*A63B 21/02* (2006.01)

(52) U.S. Cl. ..... 482/123; 482/146; 482/34

(58) Field of Classification Search ..... 482/140, 482/148, 146–147, 34, 79–80
See application file for complete search history.

(56) References Cited

U.S. PATENT DOCUMENTS 3,702,188 A * 11/1972 Phillips et al. ..... 482/113
3,802,701 A * 4/1974 Good, Jr. ..... 482/119
4,036,490 A 7/1977 Rice
4,089,520 A * 5/1978 Ozbey et al. ..... 482/130
4,249,727 A * 2/1981 Dehan ..... 482/117
4,305,579 A 12/1981 Rice
4,353,544 A * 10/1982 Wiley ..... 482/59
4,428,478 A * 1/1984 Hoffman ..... 206/315.9
4,494,662 A * 1/1985 Clymer ..... 482/123
4,925,185 A 5/1990 Gongwer
5,322,492 A * 6/1994 Pearson ..... 482/129
5,342,266 A * 8/1994 Dailey ..... 482/71
5,551,934 A * 9/1996 Binette ..... 482/123
6,022,303 A * 2/2000 Abdo ..... 482/140
6,248,047 B1 * 6/2001 Abdo ..... 482/130
6,497,560 B2 * 12/2002 Carlson ..... 417/553

(Continued)

FOREIGN PATENT DOCUMENTS

WO WO 2005/025688 3/2005

*Primary Examiner*—Lori Baker
(74) *Attorney, Agent, or Firm*—Renner, Kenner Greive, Bobak Taylor < Weber

(57) ABSTRACT

A training device (10) for exercising the abdominal muscles (40) of a user (30), comprises a base portion (11), an upstanding resistance member (21) contained within a housing (12) and a plunger (13). The resistance member (21) is operably connected to the plunger (13) and is biased normally to urge the plunger (13) upwardly out of the housing (12). By standing on the base portion (11) and exerting a downward force (c) on the plunger (13) whilst keeping his arms (41, 42) and legs (43, 44) straight, the user (30) causes his abdominal muscles (40) to work to overcome the resistance to the downward motion of the plunger (13) provided by the resistance member (21), thus driving the plunger (13) downwards into the housing (12).

9 Claims, 4 Drawing Sheets

U.S. PATENT DOCUMENTS 6,775,904 B1 * 8/2004 Duebel ..... 29/760
6,821,235 B1 * 11/2004 Johnson et al. ..... 482/79
6,827,673 B2 * 12/2004 Chen et al. ..... 482/77
6,994,370 B2 * 2/2006 Sabol ..... 280/618
7,115,071 B1 * 10/2006 Sunbeck ..... 482/8
7,223,215 B2 * 5/2007 Bastyr ..... 482/115
7,445,586 B2 * 11/2008 Gibson ..... 482/142
7,559,881 B1 * 7/2009 Roraff ..... 482/129
7,608,028 B2 * 10/2009 Pertegaz-Esteban ..... 482/139
2003/0230870 A1 * 12/2003 Sabol ..... 280/618
2008/0038119 A1 * 2/2008 Kan ..... 417/63
2009/0280968 A1 * 11/2009 Weir et al. ..... 482/123
2009/0285697 A1 * 11/2009 Sorensen ..... 417/258
2009/0286659 A1 * 11/2009 Brown ..... 482/112
2010/0028180 A1 * 2/2010 Gerritsen ..... 417/556

* cited by examiner

ABDOMINAL MUSCLE TRAINING DEVICE

BACKGROUND OF THE INVENTION

This invention relates to a training device for exercising a user's abdominal muscles. In particular, it relates to such a device which enables the user to exercise in a standing position.

Known fitness equipment for training a user's abdominal muscles generally operates with the user in a supine body position. However, for users lacking mobility, such as those who are disabled, obese or elderly, it can be difficult comfortably to adopt the supine position, and even more difficult to return to a standing position afterwards. As a result, those users who are likely to benefit most from abdominal muscle training can find themselves excluded from performing such exercise.

Abdominal muscle training devices operable with the user in a seated position have also been proposed, but these too are not without their shortcomings. In particular, effective training of the abdominal muscles requires the performance of a range of different dynamic movements, working against an applied resistive load, and such a range of movements cannot practicably be achieved in either a seated or supine position.

Furthermore, in order to optimise the efficiency of muscle training, it is highly desirable that the training exercises performed should be specific to the task being trained for, and thus target the appropriate muscle groups. Most physically demanding tasks, whether occurring on the sports field or in everyday activities, are performed in an upright, standing position rather than in the supine or seated postures employed by known abdominal muscle training devices. The specificity and efficiency of muscle training exercises performed utilising such devices is therefore compromised.

SUMMARY OF THE INVENTION

The present invention seeks to address the above issues by providing a training device which allows the user to remain in a comfortable and convenient standing position whilst exercising the abdominal muscles. The device enables the user to perform a range of dynamic movements against an applied resistive load from this position, thus enhancing the efficiency and specificity of the exercise.

According to the present invention there is provided a training device for exercising a user's abdominal muscles, comprising a base portion adapted to support a user in a standing position, a resistance member generally upstanding from the base portion, and a plunger adapted for vertical downward motion against the resistance member upon the manual application of a force.

The term "plunger" is used herein to refer to any component adapted to be manually depressed by a user against a resistive load provided by the resistance member.

The present invention may be constructed in a wide range of different configurations, and comprising various kinds of resistance member. However, it is currently preferred that the resistance member comprises a spring mounted within a generally tubular housing upstanding from the base portion, said housing being adapted also to accommodate a lower part of the plunger when a downwardly directed force is applied thereto.

The spring is secured at its lower end to the base portion and preferably comprises a head element at its upper end, for engaging with the lower end of the plunger. The spring is biased normally to urge the plunger upwards out of the top of the housing. The user must therefore work against the resistance of the spring by manually applying a force to the plunger to urge it downwards into the housing, thus compressing the spring. Releasing the applied force from the plunger releases the compression in the spring, thus urging the plunger back upwards to its initial rest position.

The sequence of manually applying a force to the plunger and subsequently releasing it requires the user's abdominal muscles to contract and expand—the plunger being depressed when the abdominal muscles work to overcome the resistance of the spring. The sequence will typically be repeated many times by the user during the performance of abdominal muscle training exercise.

The housing preferably has an annular cap provided at its upper end, which serves both to permit the sliding motion of the lower part of the plunger into and out of the housing, and also to retain the spring within the housing. A retaining element is preferably provided adjacent the lower end of the plunger, said retaining element being adapted to prevent inadvertent removal of the plunger from the housing, by bearing against the annular cap of the housing. The annular cap may desirably be provided with one or more bearings to facilitate the motion of the plunger into and out of the housing.

The lower end of the plunger is preferably further adapted to engage with the upper end of the spring. This is most preferably achieved by providing a threaded portion at the lower end of the plunger, said threaded portion being adapted to engage with a complementary threaded aperture in the head element at the upper end of the spring. The complementary threaded engagement of the head element and the plunger enables the resistive load presented by the spring to be adjusted. This is done by rotating the plunger relative to the housing, thereby varying the separation between the head element and the retaining element.

In order that the training device of the present invention may enable the user to perform a range of abdominal muscle training exercises, the base portion preferably comprises an upper footplate mounted for rotation on a fixed lower section. This allows the user to perform torso twisting exercises in addition to the basic abdominal contraction exercises associated with depressing and releasing the plunger. These torso twists may be performed either independently of the basic abdominal exercise or simultaneously therewith.

To provide a resistive load for the user to work against during the performance of the torso twisting exercises, the rotatable footplate is preferably linked to the fixed lower section by a further resistive element. Said further resistive element may be either an elastic resistance element or a frictional resistance element. The base portion may additionally comprise a locking mechanism temporarily to prevent rotation of the footplate. This option is provided in order that newcomers to abdominal muscle training may begin by performing the basic abdominal contraction exercises before moving on to incorporate torso twisting exercise into their training regime.

The base portion preferably further comprises a roughened upper surface to provide grip for the user's feet. This facilitates the transfer of torque from the user's twisting motion to overcome the resistance provided by the further resistive element in the base portion.

For the comfort of the user, and to enable both one-handed and two-handed operation, the plunger is preferably generally T-shaped having an upper horizontally disposed handle section and a lower vertically disposed shaft section.

In order that the training device of the present invention may conveniently be folded up for transport or storage when not in use, the housing is preferably hingedly mounted on the base portion. The housing, spring and plunger assembly may thus be folded down to lie co-planar with the base portion.

BRIEF DESCRIPTION OF THE DRAWINGS

In order that the present invention may be fully understood, a preferred embodiment will now be described in detail, though only by way of example, with reference to the accompanying drawings, in which.

DETAILED DESCRIPTION OF THE INVENTION

Figure 1:
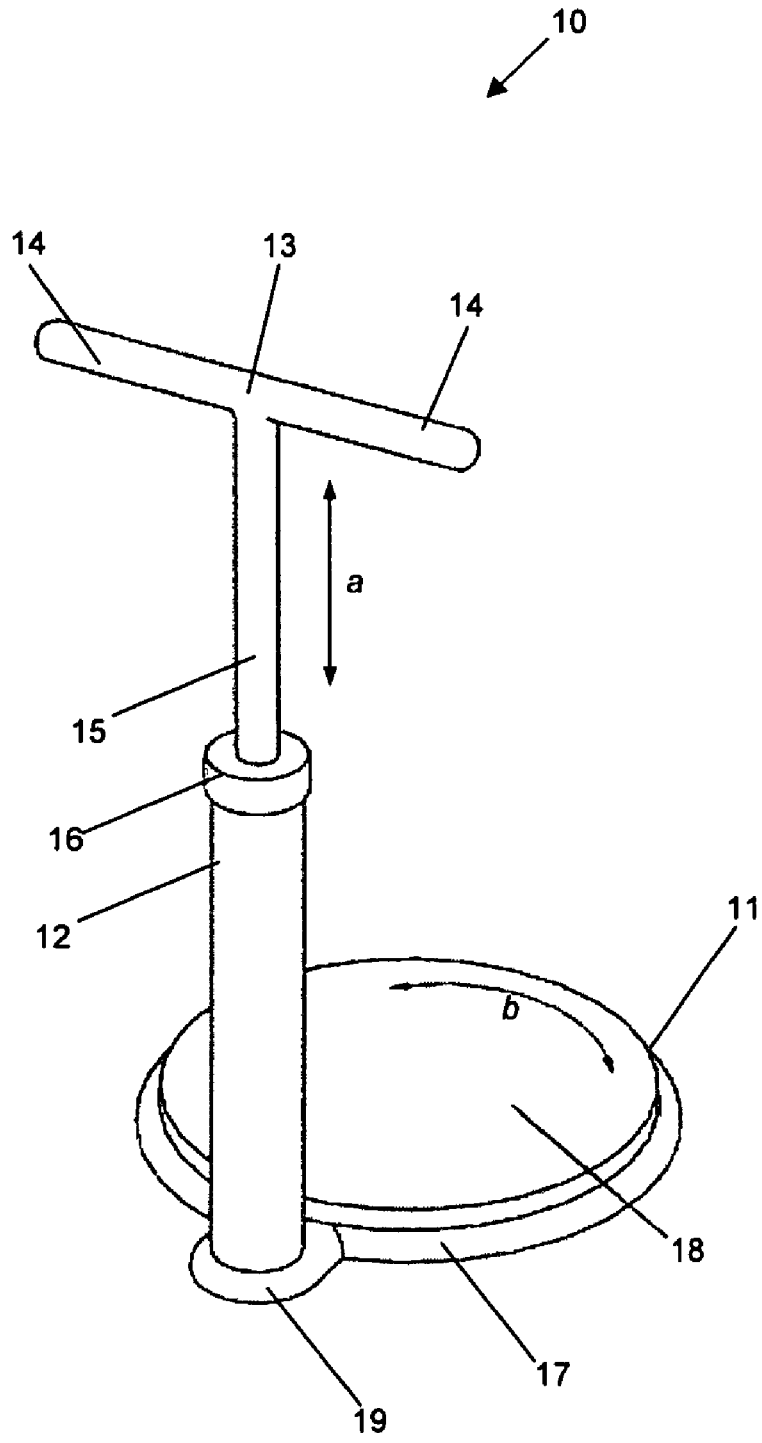
FIG. 1 is a perspective view of a preferred embodiment of training device according to the present invention.

Referring first to FIG. 1, there is shown an abdominal muscle training device, generally indicated 10, according to a preferred embodiment of the present invention. The device 10 comprises a base portion 11, an upstanding tubular housing 12, and a T-shaped plunger 13 mounted for sliding movement into and out of the housing 12, as indicated by arrow a. The plunger 13 has a horizontally disposed handlebar 14 and vertically disposed shaft 15 which engages with an annular cap 16 provided at the top of the housing 12 as will be discussed in more detail below with reference to FIG. 2.

The base portion 11 comprises a fixed lower section 17, and an upper footplate 18 rotatably mounted on said lower section, as indicated by arrow b. An extension of the fixed lower section 17 forms a base 19 for the upstanding housing 12. The extension 19 is hingedly mounted on the lower section 17 to enable the plunger 13 and housing 12 assembly to be folded down to overlie the base portion 11 when the training device 10 is not in use.

Figure 2:
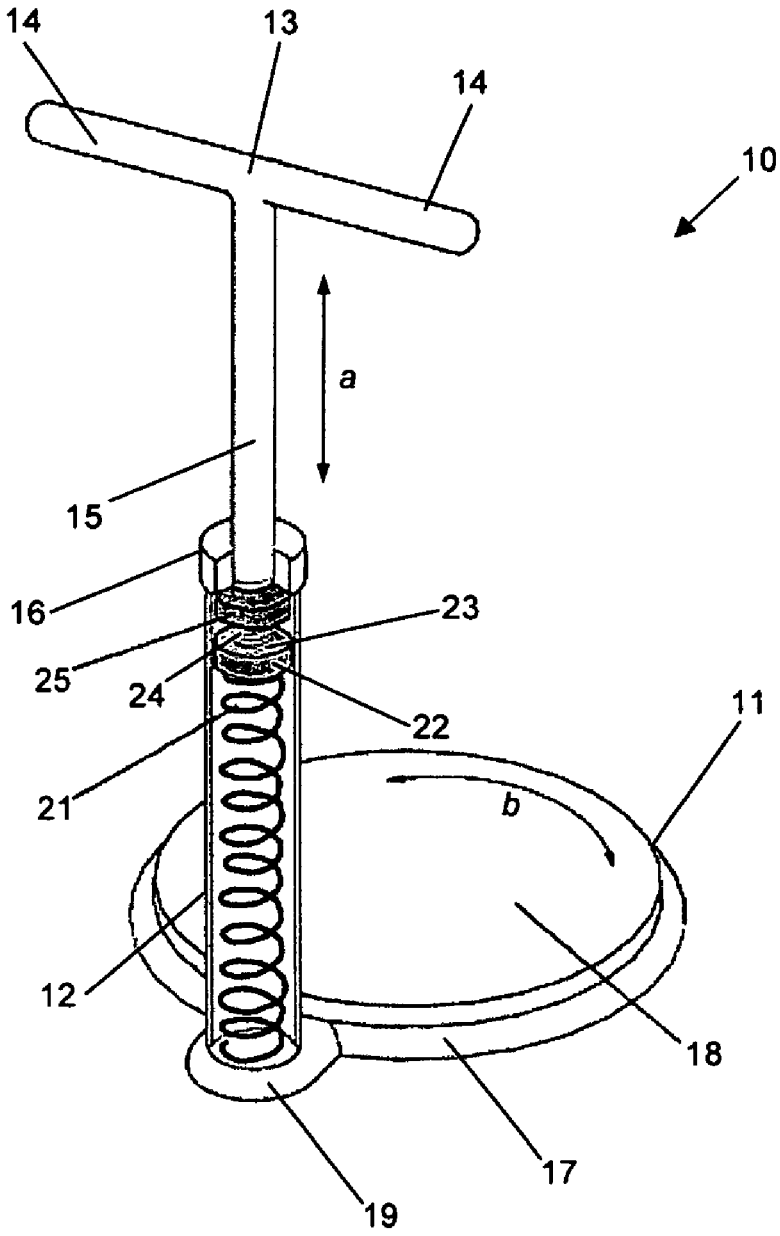
FIG. 2 is a partially cut-away perspective view of the training device of FIG. 1.

Referring now to FIG. 2, this shows the mechanism within the housing 12 by which the training device 10 operates. A spring 21 is mounted within the housing 12, secured at its lower end to the housing base 19, and having a head element 22 provided at its upper end. The head element 22 has a threaded aperture 23 adapted to engage with a complementary threaded portion 24 provided on the lower end of the plunger shaft 15. The threaded portion 24 of the plunger shaft 15 is also provided with a retaining element 25.

The spring 21 is biased normally to urge the head element 22 upwards, thus in turn urging the plunger 13 to a rest position wherein nearly the entire length of the shaft 15 lies outside the housing 12. When in this rest position, as shown in FIG. 2, the upper surface of the retaining element 25 abuts against the underside of the annular cap 16, thus preventing the plunger 13 from being entirely ejected or withdrawn from the housing 12.

In use, the plunger 13 is subjected to the manual application of a force, by the user (not shown in FIG. 2) pushing downwards on the handlebar 14. The plunger shaft 15 is thus urged downwards through the annular cap 16, into the housing 12. Bearings (not shown) are provided in the annular cap 16 to facilitate the passage of the shaft 15 therethrough. The downward motion of the plunger 13 is resisted by the spring 21, so that the user's abdominal muscles must work to overcome the resistance in order for the plunger 13 to become fully depressed into the housing 12, as will be described in more detail below with reference to FIGS. 3*a* and 3*b*.

Upon releasing the manually-applied force from the handlebar 14, the compression in the spring 21 is released, which urges the head element 22 upwards, thus in turn urging the plunger 13 back up to its rest position. The sequence of manually applying a downwardly-directed force to the handlebar 14 and subsequently releasing that force, will typically be repeated many times during the performance of abdominal muscle training exercise.

In addition to, or as an alternative to, the operation of the plunger 13 as described above, the user also has the option of exercising using the rotatable footplate 18, as will be described in more detail below with reference to FIGS. 4*a* and 4*b*. The footplate 18 is mounted for rotational movement on the fixed lower section 17, and is linked thereto by a further resistive element (not shown). In order to cause the footplate 18 to rotate, the user's abdominal muscles must work to provide sufficient torque to overcome the resistance provided by the further resistance element. The footplate 18 is also provided with a locking mechanism (not shown) to prevent rotation when this option is not required.

Figure 3A:
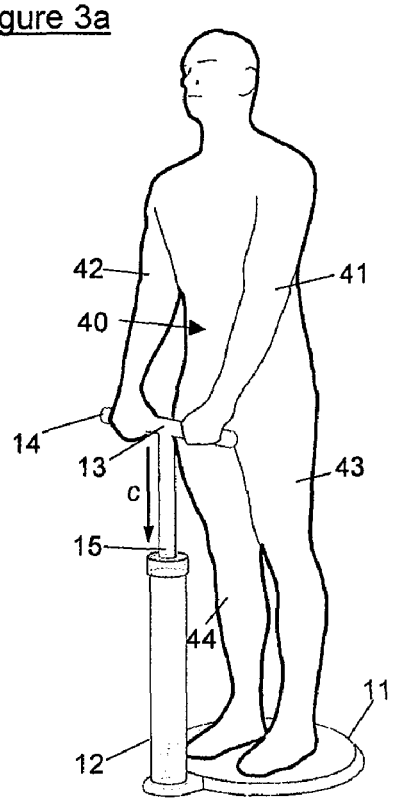
FIGS. 3*a* and 3*b* form an illustrative sequence showing a user performing a basic abdominal muscle training exercise using the training device of FIGS. 1 and 2.
Figure 3B:
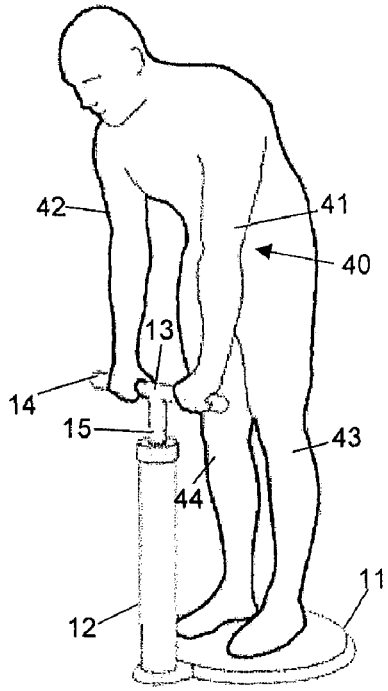

Referring now to FIGS. 3*a* and 3*b*, these show a user, generally indicated 30, performing a basic abdominal muscle contraction exercise using the training device 10. The user 30 begins with the device 10 in the rest position, as shown in FIG. 3*a*, and stands on the base portion 11, facing the housing 12. The user's hands 31, 32 are placed on the handlebar 14 of the plunger 13, and used to exert a downwardly directed force on the plunger 13, as indicated by arrow c. The plunger shaft 15 is thus urged into the housing 12, working against the resistance of the spring 21 (not visible) until the position shown in FIG. 3*b* is reached.

As can be seen from FIG. 3*b*, the plunger 13 is now fully depressed into the housing 12. The user 30 is now in a bent over position, having contracted his abdominal muscles, generally indicated 40, in order to overcome the resistance of the spring 21. The user 30 keeps his arms 41, 42 and legs 43, 44 straight during the exercise to ensure that the work required to overcome the resistance of the spring 21 is done primarily by his abdominal muscles 40. When the force c applied by the user 30 is released, the spring 21 urges the plunger 13 back to the rest position shown in FIG. 3*a*. The user 30 thus experiences a pushing force returning him from the bent over position shown in FIG. 3*b* to the standing position shown in FIG. 3*a*, and expanding his abdominal muscles 40.

Figure 4A:
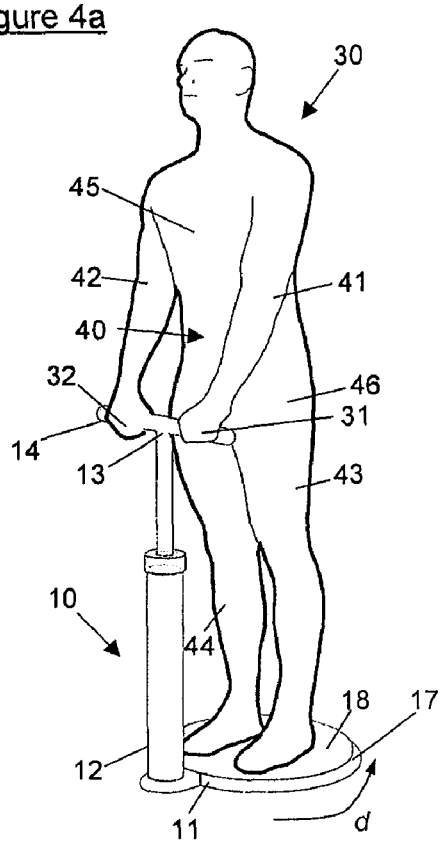
FIGS. 4*a* and 4*b* form an illustrative sequence showing a user performing an alternative abdominal muscle training exercise using the training device of FIGS. 1 and 2.
Figure 4B:
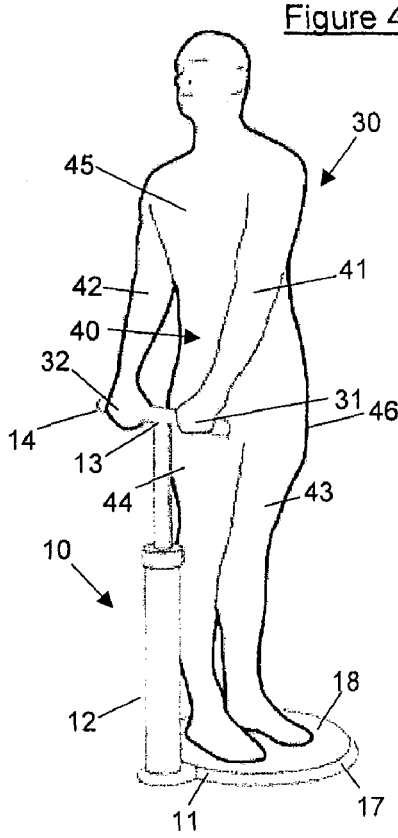

Referring now to FIGS. 4*a* and 4*b*, these show the user 30 performing an abdominal muscle twisting exercise using the training device 10. As with the basic abdominal contraction exercise, the user 30 begins with the device 10 in the rest position, as shown in FIG. 4, and stands on the base portion 11, facing the housing 12, with his hands 31, 32 on the handlebar 14 of the plunger 13. However, for the abdominal muscle twisting exercise the user 30 does not depress the plunger 13 but merely uses it as a grip to ensure that his upper torso 45 remains stationary during performance of the exercise.

Keeping his arms 41, 42 and legs 43, 44 straight, the user 30 then rotates his hips 46, exerting a rotational force (torque) on the footplate 18, as indicated by arrow d. The footplate 18 is caused to rotate relative to the fixed lower section 17 of the base portion 11, working against the resistance provided by the further resistive element (not shown) until the position shown in FIG. 4*b* is reached.

As can be seen from FIG. 4*b*, the footplate 18 has now rotated through substantially 90° relative to the fixed lower section 17. The user 30 is now in a twisted position with his legs 43, 44 and hips 46 arranged at substantially 900 relative to his arms 41,42 and upper torso 45. The work required to overcome the resistance between the footplate 18 and the lower section 17 has again been done by the user's abdominal muscles 40. When the torque d applied by the user 30 is released, the resistive element in the base portion 11 urges the footplate 18 back to the rest position shown in FIG. 4*a*. The user 30 thus experiences a rotational force returning his legs 43, 44 and hips 46 from the twisted position shown in FIG. 4*b* to the rest position shown in FIG. 4*a*. The user 30 can then perform a complementary abdominal twisting exercise by rotating his hips 46 and the footplate 18 in the opposite direction.

Figure 5A:
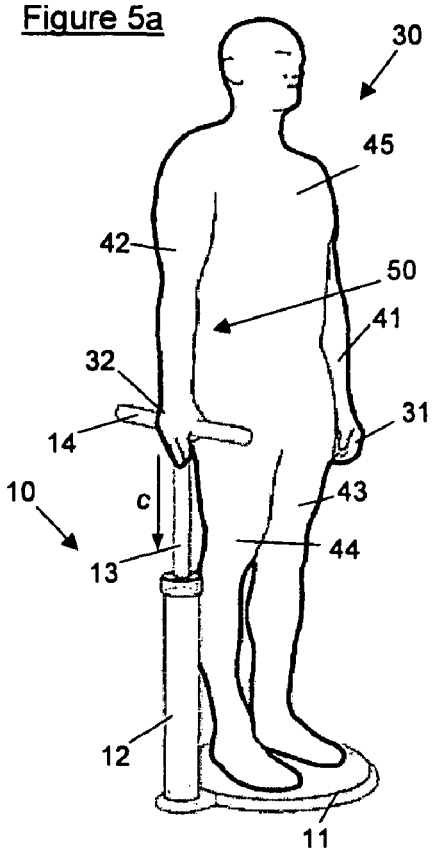
FIGS. 5*a* and 5*b* form an illustrative sequence showing a user performing a further alternative abdominal muscle training exercise using the training device of FIGS. 1 and 2.
Figure 5B:
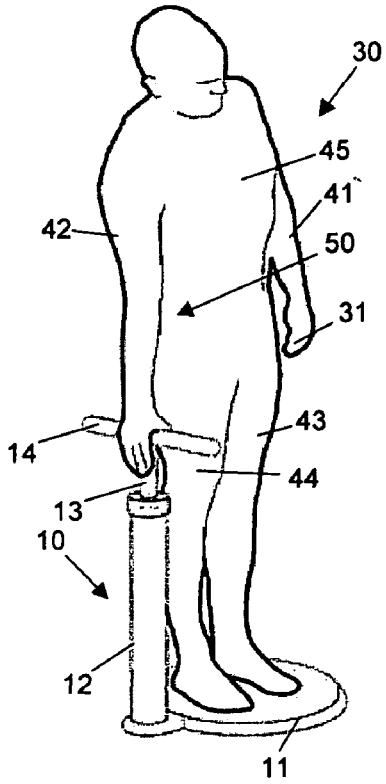

Referring now to FIGS. 5*a* and 5*b*, these show the user 30 performing an oblique (side) abdominal muscle training exercise using the training device 10. To perform this exercise the user 30 adopts a starting position, as shown in FIG. 5*a*, standing on the base portion 11, with the housing 12 on his right hand side 32, rather than facing towards the housing 12 as previously. The user 30 places his right hand 32 only on the centre of the handlebar 14, leaving his left hand 31 free.

Keeping his legs 43, 44 and right arm 42 straight, and with his left arm 41 free, the user 30 then exerts a downward force c on the plunger 13, urging it into the housing 12. The work required to overcome the resistance in the spring 21 (not visible) is done by the user's oblique (side) abdominal muscles, generally indicated 50, on his right hand side 32. As can be seen in FIG. 5*b*, when the plunger 13 is depressed to its full extent, the user's upper torso 45 is bent over to his right hand side 32, effecting a contraction of the oblique abdominal muscles 50 on that side. When the user 30 releases the downwardly directed force c from the plunger 13, the spring 21 urges the plunger 13 back to its rest position as shown in FIG. 5*a*. The user 30 may then turn through 180° and repeat the exercise with his left hand 31 on the handlebar so as to exercise the oblique abdominal muscles 50 on his left hand side 31.

Figure 6A:
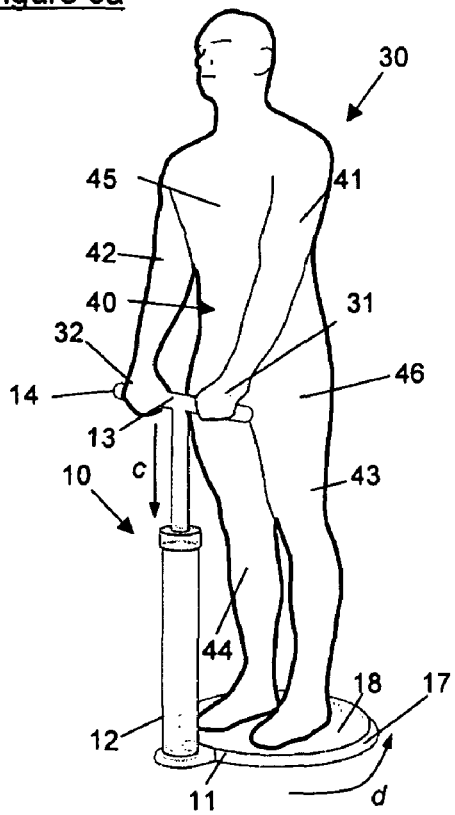
FIGS. 6*a* and 6*b* form an illustrative sequence showing a user performing a compound abdominal muscle training exercise using the training device of FIGS. 1 and 2.
Figure 6B:
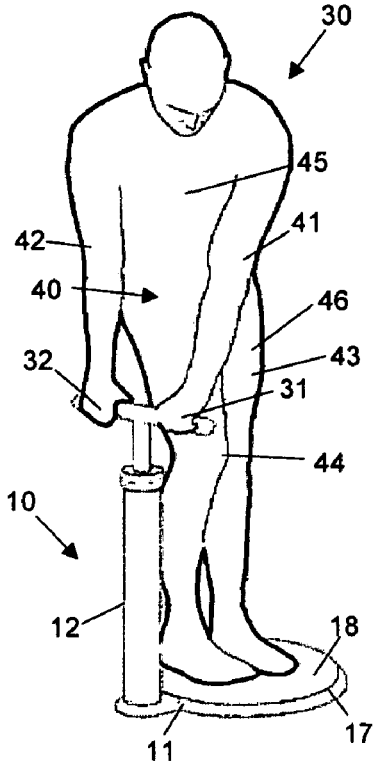

Referring finally to FIGS. 6*a* and 6*b*, these show the user 30 performing a compound abdominal muscle training exercise using the training device 10. This exercise combines the basic abdominal muscle contraction exercise described above with reference to FIGS. 3*a* and 3*b* with the abdominal muscle twisting exercise described above with reference to FIGS. 4*a* and 4*b*. As shown in FIG. 6*a*, the user 30 adopts the original starting position, standing on the base portion 11, facing the housing 12, with his hands 31, 32 on the handlebar 14 of the plunger 13.

Keeping his arms 41, 42 and left leg 43 straight, the user 30 then exerts a downwardly directed force c on the plunger 13, whilst simultaneously rotating his hips 46 to the left to exert a rotational force d on the footplate 18. The user's abdominal muscles 40 thus work to overcome both the resistance in the spring 21 (not visible) and the further resistive element (not shown) between the footplate 18 and the fixed lower section 17 of the base portion 11.

As shown in FIG. 6*b*, performing the compound exercise results in the plunger 13 being depressed fully into the housing 12, and the footplate 18 rotated through substantially 90° to the user's left 31. In performing the exercise, the user 30 executes both contraction and rotation of his abdominal muscles 40, so that his end position, as shown in FIG. 6*b*, is both bent over and twisted, with his legs 43, 44 and hips 46 rotated to his left 31 relative to his arms 41, 42 and upper torso 45. In order to adopt this position, the user 30 must slightly bend his right leg 44 during the exercise.

Upon the user 30 releasing the downwardly directed force c and the rotational force d, the spring 21 and the resistive element in the base portion 11 urge the plunger 13 and the footplate 18 respectively, back to their rest position as shown in FIG. 6*a*. The user 30 also experiences a pushing force urging him back to his rest position. The user 30 may then execute a complementary compound abdominal muscle training exercise by exerting a downwardly directed force c on the plunger 13, whilst simultaneously rotating his hips 46 to the right to exert a rotational force d on the footplate 18, this time keeping his right leg 44 straight and slightly bending his left leg 43.

The invention claimed is:

1. An abdominal muscle training device comprising:

a base portion having an upper footplate and a fixed lower section, said upper footplate being mounted for rotation on said fixed lower section;

a resistance member comprising a spring, said resistance member being generally upstanding from the base portion; and a plunger arranged for vertical downward motion against the resistance of the resistance member; and a generally tubular housing for the resistance member said housing upstanding from the base portion and having an upper end comprising an annular cap provided with at least one bearing to facilitate motion of the plunger relative to the housing, said housing being further adapted to accommodate a lower part of the plunger when said plunger is depressed;

wherein said spring is mounted within the housing and has a lower end attached to said base portion and an upper end provided with a head element, said head element being adapted for connection to said plunger;

wherein said plunger has a lower end comprising a retaining element adapted to prevent inadvertent removal of said lower end of said plunger from said housing; and wherein said upper footplate is adapted to support a user in a standing position from which position said user can perform exercise against the resistance of the resistance member by manually applying a downwardly force to depress the plunger.

2. The training device as claimed in claim 1, wherein the lower end of the plunger further comprises a threaded portion; and the head element further comprises a threaded aperture complementary to said threaded portion and adapted to engage therewith.

3. The training device as claimed in claim 2, wherein the spring provides a resistive load, said resistive load being adjustable by rotating the plunger relative to the housing, thereby varying the separation between the head element and the retaining element.

4. The training device as claimed in claim 1, wherein the housing is hingedly mounted on the base portion to enable folding of the device when not in use.

5. The training device as claimed in claim 1, further comprising a further resistive element arranged to link the footplate to the fixed lower section.

6. The training device as claimed in claim 5, wherein said further resistive element is selected from an elastic resistance element and a frictional resistance element.

7. The training device as claimed in claim 1, wherein the base portion further comprises a locking mechanism adapted temporarily to prevent rotation of the footplate.

8. The training device as claimed in claim 1, wherein the plunger is generally T-shaped, having an upper horizontally disposed handle section and a lower vertically disposed shaft section.

9. The training device as claimed in claim 1, wherein the footplate comprises a roughened upper surface adapted to provide grip for a user's feet.

* * * * *